US005433782A

United States Patent [19]

Filbert et al.

[11] Patent Number: 5,433,782

[45] Date of Patent: Jul. 18, 1995

[54] ENVELOPE AND STAMP MOISTURIZER

[76] Inventors: John A. Filbert, P.O. Box 72073; Serena A. Filbert, P.O. Box 72073, both of Baltimore, Md. 21237

[21] Appl. No.: 341,693

[22] Filed: Nov. 18, 1994

Related U.S. Application Data

[63] Continuation of Ser. No. 61,297, May 14, 1993, abandoned.

[51] Int. Cl.[6] ..... B05C 17/005

[52] U.S. Cl. ..... 118/266; 118/264; 222/523; 401/89; 401/119; 401/130; 401/139; 401/170; 401/184; 401/195; 401/262; D19/67; D19/70; D19/71

[58] Field of Search ..... 401/89, 118, 119, 120, 401/124, 130, 139, 170, 183, 184, 195, 262, 263; 118/264, 266; 222/398, 523; D19/67, 70, 71

[56] References Cited

U.S. PATENT DOCUMENTS

| | | | |
|---|---|---|---|
| 211,104 | 1/1879 | Mulford | 401/183 |
| D. 303,926 | 10/1989 | Venne et al. | D19/71 X |
| 649,777 | 5/1990 | Truscott | 401/89 |
| 846,442 | 3/1907 | Ashley | 401/89 |
| 929,990 | 8/1909 | Shields | 222/398 |
| 1,003,267 | 9/1911 | Jones | 118/264 |
| 1,303,814 | 5/1919 | Crane | 222/398 |
| 1,537,667 | 5/1925 | Golden et al. | 118/264 |
| 2,180,506 | 11/1939 | Burbig | 118/264 |
| 2,917,766 | 12/1959 | Ciffo | 401/120 |
| 3,184,779 | 5/1965 | Lloyd | 401/183 |
| 3,229,866 | 1/1966 | Arbitman et al. | 401/263 |
| 3,870,186 | 3/1975 | Reinhard | 401/118 X |
| 5,020,930 | 6/1991 | Kuhn | 401/262 X |

FOREIGN PATENT DOCUMENTS

| | | | |
|---|---|---|---|
| 3129462 | 2/1983 | Germany | 118/264 |
| 151782 | 10/1955 | Sweden | 118/264 |
| WO89/05107 | 6/1989 | WIPO | 401/263 |

*Primary Examiner*—Mark A. Osele

[57] ABSTRACT

A new and improved moistening apparatus is used with a squeezable bottle and includes a moisture dispensing assembly connected by a friction fit to the mouth portion of the bottle. The moisture dispensing assembly includes a stopper assembly, a moisture dispensing element (such as a sponge) supported by the stopper assembly, and a conduit tube assembly connected to and in fluid communication with the moisture dispensing element. The conduit tube assembly extends from the moisture dispensing element to an interior portion of the bottle for conveying water from the bottle to the moisture dispensing element. By squeezing the bottle, water is forced by positive pressure from the body portion through the conduit tube assembly to the moisture dispensing element. The stopper assembly, connected to the mouth of the bottle by a friction fit, may include a stopper element that has a plurality of stepped portions each including a different outer diameter, such that the different stepped portions are capable of fitting into different-size mouth portions of different bottles. The stepped portion which has the largest outer diameter may include a threaded outer portion. A complementarily threaded cap may be attached to the threaded outer portion to seal the moisture within the bottle. The conduit tube assembly may include two telescopically connected members for adjusting the effective length of the conduit tube assembly. A stamp supply retention assembly may be connected to an exterior portion of the stopper assembly for facilitating moistening of the stamps.

2 Claims, 4 Drawing Sheets

ENVELOPE AND STAMP MOISTURIZER

This application is a continuation of application 08/061,279, filed May 14, 1993, now abandoned.

BACKGROUND OF THE INVENTION

1. Field of the Invention

The present invention relates generally to devices for moistening envelopes and stamps prior to sealing or affixing, and more particularly, to a small, hand-held device especially adapted for applying moisture to moisture activated adhesives for envelopes and stamps.

2. Description of the Prior Art

Moisture activated adhesives are in common use on envelopes, stamps, labels, and the like. Commonly, a person will use one's tongue to apply moisture to the moisture activated adhesive. However, there are a number of reasons why a person would rather not use one's tongue. There are health concerns with respect to toxicity of the adhesive. The adhesive may have a bad taste. One may not want to spread germs that inevitably are present in one's saliva. Often too much or too little saliva is used and the moisture activated adhesive will not function properly.

For the reasons just mentioned, mechanical moisteners have been developed. A number of such mechanical moisteners are disclosed in the following U.S. Pat. Nos. 3,905,325; 4,771,727; 4,873,941; 5,006,194; and 5,024,180. More specifically, U.S. Pat. Nos. 3,905,325, 4,771,727, 4,873,941, and 5,006,194 relate to complex mechanical systems that are heavy and not suitable for hand-held use. In this respect, it would be desirable if an envelope and stamp moistening device were provided that was light weight and suitable for hand-held use.

U.S. Pat. No. 5,024,180 discloses a small envelope and stamp moistening device that is suitable for hand-held use. However, the device in this patent uses a roller that is partially immersed in a supply of water retained in a container. The top of the container is open to accommodate the roller. Although this device is small, light weight, and may be hand-held, this device cannot readily be manipulated by the hand because the water supply may spill. More specifically, the device cannot be inverted without spilling the water supply. Also, the device cannot be vigorously moved from side to side without water sloshing out of the container and causing a mess. In this respect, it would be desirable if an envelope and stamp moistening device were provided that could be inverted without spilling the water supply. Also, it would be desirable if an envelope and stamp moistening device were provided that did not spill water when the device is moved from side to side.

Another problem associated with the envelope and stamp moistening device shown in U.S. Pat. No. 5,024,180 is the fact that this device depends solely upon the passive soaking action of water into the roller for moistening the roller. If the water does not soak into the roller quickly enough for the job at hand, then an insufficient water supply will be present in the roller for the moistening operation. In this respect, it would be desirable if an envelope and stamp moistening apparatus device were provided that included a positive pressure water applying system that improved upon passive soaking methods.

Still another problem associated with the envelope and stamp moistening device shown in U.S. Pat. No. 5,024,180 is that the device often times cannot be readily carried by a person to a job site. Because of the open nature of the water supply and roller, this device cannot be carried in person's pocket without serious spillage. In this respect, it would be desirable if an envelope and stamp moistening device were provided that could readily be carried in person's pocket without the risk of spillage.

The quantity of envelopes and stamps to be moistened may vary considerably from place to place. Some people may need to moisten many envelopes and stamps. Some people may need to moisten only a few. In this respect, it would be desirable if an envelope and stamp moistening device were provided that was readily adaptable to small or large water supplies.

Sometimes an envelope and stamp moistening device is primarily used only for moistening stamps. In this respect, it would be desirable if an envelope and stamp moistening device were provided that were especially adapted to moistening stamps, and moreover, had an adjacent stamp dispenser for readily applying moisture to the stamps as they were dispensed from the dispenser.

Thus, while the foregoing body of prior art indicates it to be well known to use mechanical devices to moisten envelopes and stamps, the prior art described above does not teach or suggest a envelope and stamp moistening apparatus which has the following combination of desirable features: (1) is light weight and suitable for hand-held use; (2) can be inverted without spilling the water supply; (3) does not spill water when the device is moved from side to side; (4) includes a positive pressure water applying system that is an improvement over passive soaking methods; (5) can readily be carried in person's pocket without the risk water spillage; (6) is readily adaptable to small or large water supplies; and (7) is especially adapted to moistening stamps and has an adjacent stamp dispenser for readily applying moisture to the stamps as they are dispensed from the dispenser. The foregoing desired characteristics are provided by the unique envelope and stamp moisturizer of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved moistening apparatus that is used with a bottle which includes a mouth portion and a body portion. The moistening apparatus includes a moisture dispensing assembly which is connected to the mouth portion of the bottle. The moisture dispensing assembly includes a stopper assembly connected to the mouth portion of the bottle, a moisture dispensing element supported by the stopper assembly, and a conduit tube assembly connected to and in fluid communication with the moisture dispensing element. The conduit tube assembly extends from the moisture dispensing element to an interior portion of the body portion of the bottle for conveying water from the body portion to the moisture dispensing element. The moisture dispensing element may be a sponge element. The bottle may be a squeezable bottle, such that by squeezing the bottle, water may be forced by positive pressure from the body portion through the conduit tube assembly to the moisture dispensing element. The stopper assembly may be connected to the mouth portion of the bottle by a water tight friction fit.

The stopper assembly may include a stopper element which may include a plurality of stepped portions. Each respective stepped portion may include a different respective outer diameter, such that the respective stepped portions are capable of fitting into different-size respective mouth portions of different respective bottles. The respective stepped portion, which has a largest outer diameter among the respective stepped portions, may include a threaded outer portion. A complementarily threaded cap may be attached to the threaded outer portion of the largest-outer-diameter stepped portion to seal the moisture within the bottle.

The conduit tube assembly may include a first conduit member attached to the moisture dispensing element and a second conduit member telescopically connected to the first conduit member, such that an effective length of the conduit tube assembly is capable of being adjusted by moving the second conduit member with respect to the first conduit member.

A stamp supply retention assembly may be connected to an exterior portion of the stopper assembly for retaining a plurality of stamps and for permitting the stamps to be removed from the stamp supply retention assembly in a manner such that the adhesive-containing surfaces of the removed stamps contact the moisture dispensing element. The plurality of stamps may be retained in the stamp supply retention assembly in roll form. The stamp supply retention assembly may include a guide assembly for guiding the stamps to the moisture dispensing element.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved envelope and stamp moisturizer which has all of the advantages of the prior art and none of the disadvantages.

It is another object of the present invention to provide a new and improved envelope and stamp moisturizer which may be easily and efficiently manufactured and marketed.

It is a further object of the present invention to provide a new and improved envelope and stamp moistening apparatus which is of durable and reliable construction.

An even further object of the present invention is to provide a new and improved envelope and stamp moisturizer which is susceptible of a low cost of manufacture with regard to both materials and labor, and which accordingly is then susceptible of low prices of sale to the consuming public, thereby making such envelope and stamp moistening apparatus available to the buying public.

Still yet a further object of the present invention is to provide a new and improved envelope and stamp moistening apparatus which is light weight and suitable for hand-held use.

Still another object of the present invention is to provide a new and improved envelope and stamp moistening apparatus that can be inverted without spilling the water supply.

Yet another object of the present invention is to provide a new and improved envelope and stamp moisturizer which does not spill water when the device is moved from side to side.

Even another object of the present invention is to provide a new and improved envelope and stamp moistening apparatus that includes a positive pressure water applying system that is an improvement over passive soaking methods.

Still a further object of the present invention is to provide a new and improved envelope and stamp moistening apparatus which can readily be carried in person's pocket without the risk of water spillage.

Yet another object of the present invention is to provide a new and improved envelope and stamp moistening apparatus that is readily adaptable to small or large water supplies.

Still another object of the present invention is to provide a new and improved envelope and stamp moisturizer which is especially adapted to moistening stamps and which has an adjacent stamp dispenser for readily applying moisture to the stamps as they are dispensed from the dispenser.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved envelope and stamp moisturizer embodying the principles and concepts of the present invention will be described.

Figure 2:
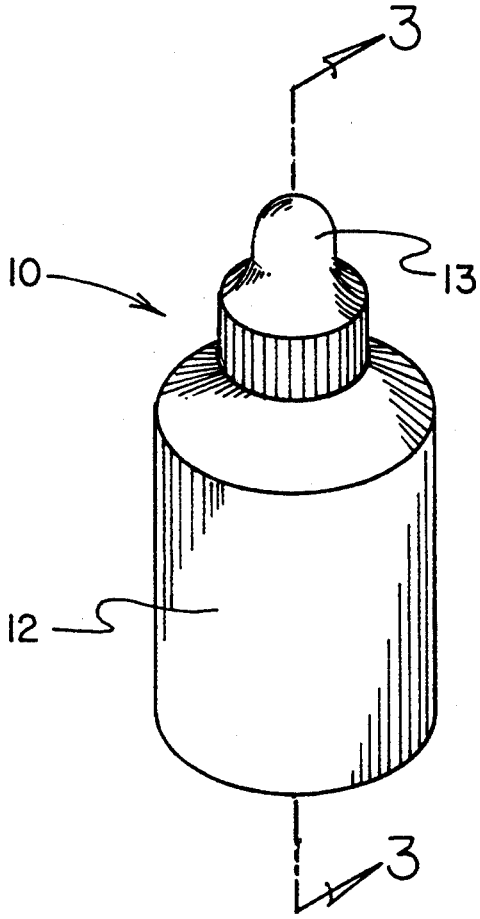
FIG. 2 is a perspective view of the embodiment of the envelope and stamp moistening apparatus shown in FIG. 1 wherein all the parts are assembled together.
Figure 1:
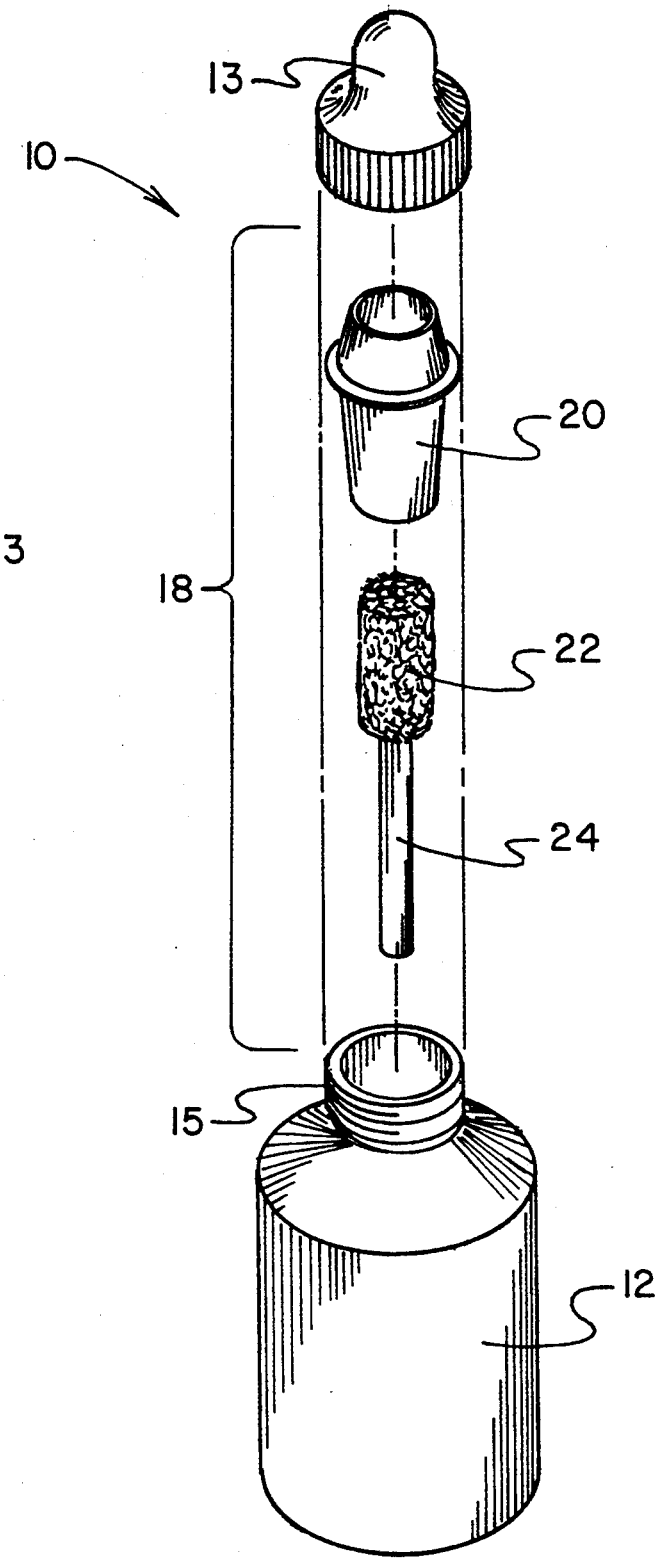
FIG. 1 is an exploded perspective view showing a first preferred embodiment of the envelope and stamp moisturizer of the invention including a bottle and cap.
Figure 3:
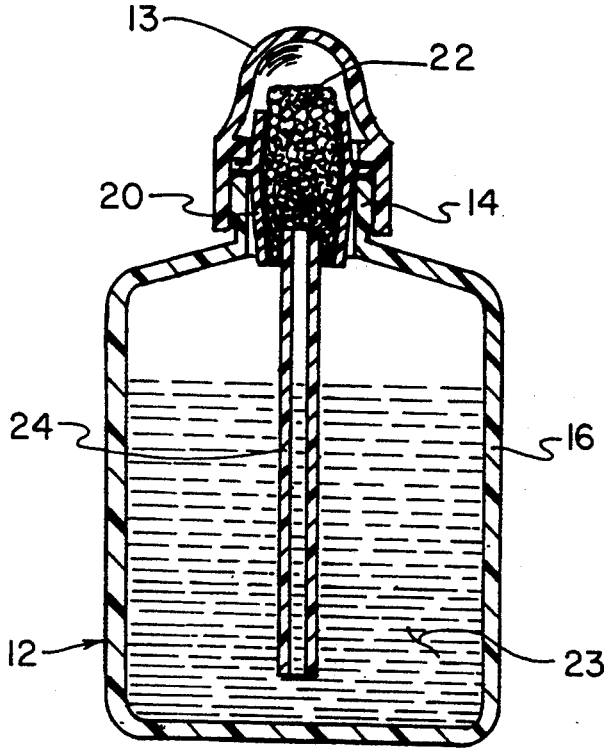
FIG. 3 is a cross-sectional view of the embodiment of the envelope and stamp moistening apparatus of FIG. 2 taken along line 3—3 thereof.

Turning initially to FIGS. 1–3, there is shown a first exemplary embodiment of the envelope and stamp moistening apparatus of the invention generally designated by reference numeral 10. In its preferred form, the envelope and stamp moistening apparatus 10 of the invention is used with a bottle 12 which includes a mouth portion 14 and a body portion 16. A cap 13 is secured to the bottle 12 with a water tight seal by having threads that screw onto complementary threads 15 on the bottle 12. The moistening apparatus includes a moisture dispensing assembly 18 connected to the mouth portion 14 of the bottle 12. The moisture dispensing assembly 18 includes a stopper assembly 20 connected to the mouth portion 14 of the bottle 12, a moisture dispensing element 22 supported by the stopper assembly 20, and a conduit tube assembly 24 connected to and in fluid communication with the moisture dispensing element 22.

The stopper assembly 20 is hollow and includes a relatively large diameter mid-portion a tapered top portion having both its inner and outer surfaces tapering upward from said mid-portion, and a tapered bottom portion having both its inner and outer surfaces tapering downward from said mid-portion.

The conduit tube assembly 24 extends from the moisture dispensing element 22 to an interior portion 26 of the body portion 16 of the bottle 12 for conveying water from the body portion 16 to the moisture dispensing element 22. The moisture dispensing element 22 is a sponge element 22. The bottle 12 is a squeezable bottle, such that by squeezing the bottle 12, water 23 is forced by positive pressure from the body portion 16 through the conduit tube assembly 24 to the moisture dispensing element 22. The stopper assembly 20 is connected to the mouth portion 14 of the bottle 12 by a water tight friction fit.

Figure 4:
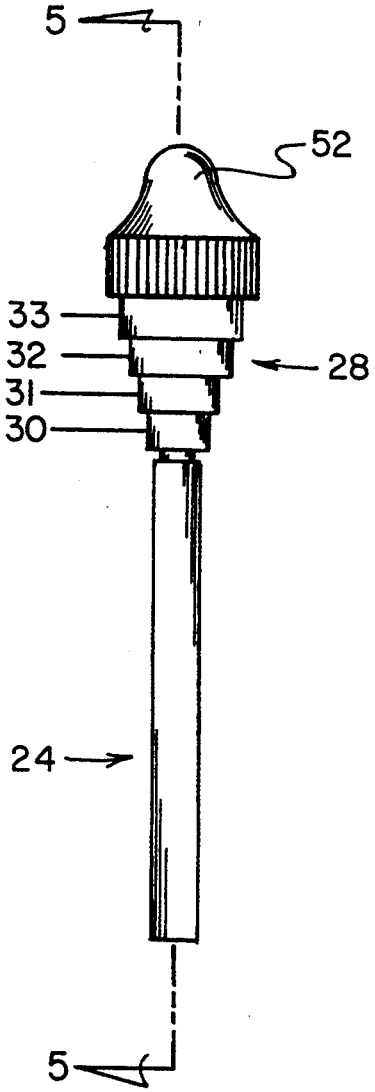
FIG. 4 is a side view of a second preferred embodiment envelope and stamp moisturizer of the invention wherein the stopper assembly includes a stopper element which includes a plurality of stepped portions having different respective outer diameter, such that the respective stepped portions are capable of fitting into different-size respective mouth portions of different respective bottles.
Figure 5:
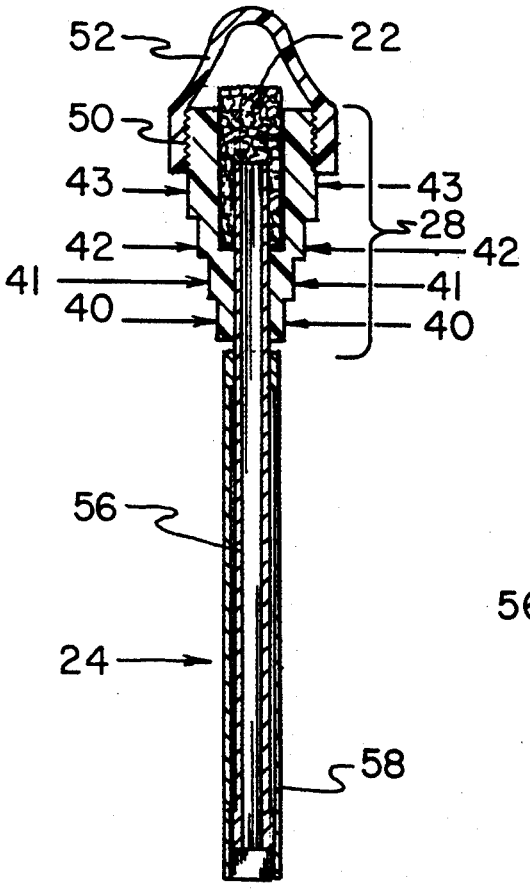
FIG. 5 is a cross-sectional view of the embodiment of the invention shown in FIG. 4 taken along line 5—5 of FIG. 4.
Figure 6:
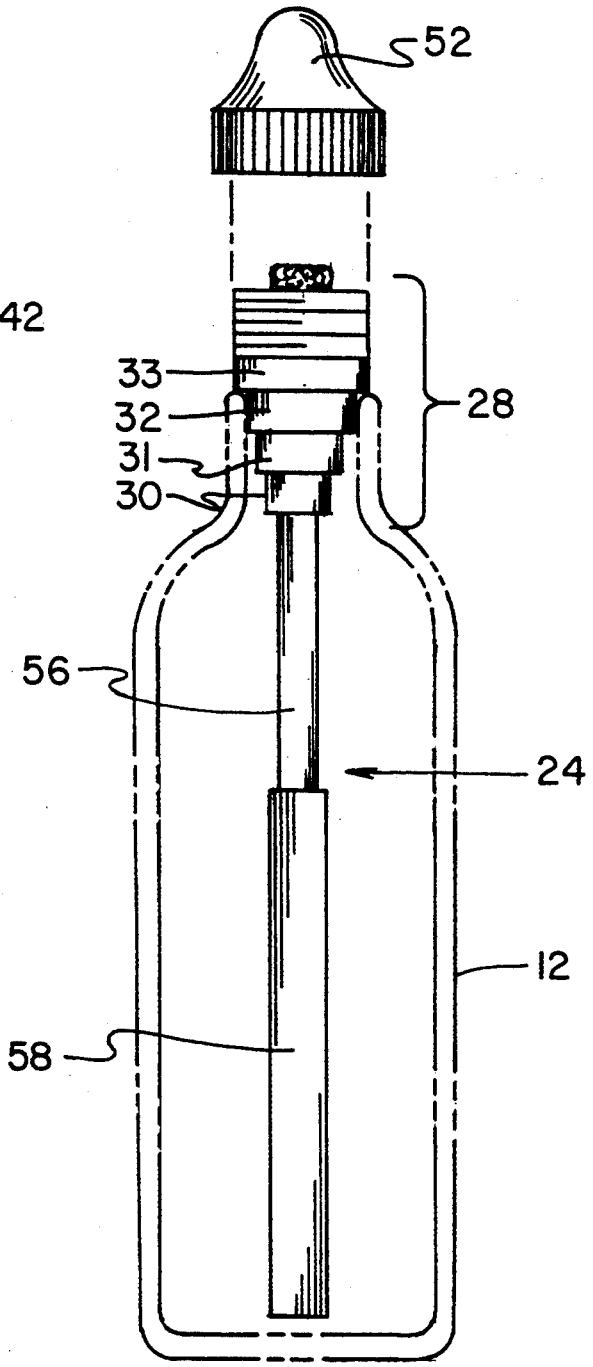
FIG. 6 is a partially exploded, partial cross-sectional view of the embodiment of the invention shown in FIG. 4 installed in a bottle.

Turning to FIGS. 4–6, a second embodiment of the invention is shown. Reference numerals are shown that correspond to like reference numerals that designate like elements shown in the other figures. In addition, the stopper assembly includes a stopper element 28 which includes a plurality of stepped portions 30, 31, 32, and 33. Each respective stepped portion includes a different respective outer diameter 40, 41, 42, and 43, such that the respective stepped portions 30, 31, 32, and 33 are capable of fitting into different-size respective mouth portions of different respective bottles. The respective stepped portion 33, which has a largest outer diameter 43 among the respective stepped portions, includes a threaded outer portion 50. A complementarily threaded cap 52 is attached to the threaded outer portion 50 of the largest-outer-diameter stepped portion 33 to form a water tight seal to seal the moisture within the bottle 12. As shown in FIG. 6, the stepped portion 32, having outer diameter 42, is fitted into the mouth of the bottle 12 by a water tight friction fit. The water tight seals between the respective cap and the bottle, the cap and the stopper assembly, and the stopper assembly and the mouth of the bottle prevent water from leaking out of the envelope and stamp moistening apparatus of the invention.

The conduit tube assembly 24 includes a first conduit member 56 attached to the moisture dispensing element 22 and a second conduit member 58 telescopically connected to the first conduit member 56, such that an effective length of the conduit tube assembly 24 is capable of being adjusted by moving the second conduit member 58 with respect to the first conduit member 56.

Figure 7:
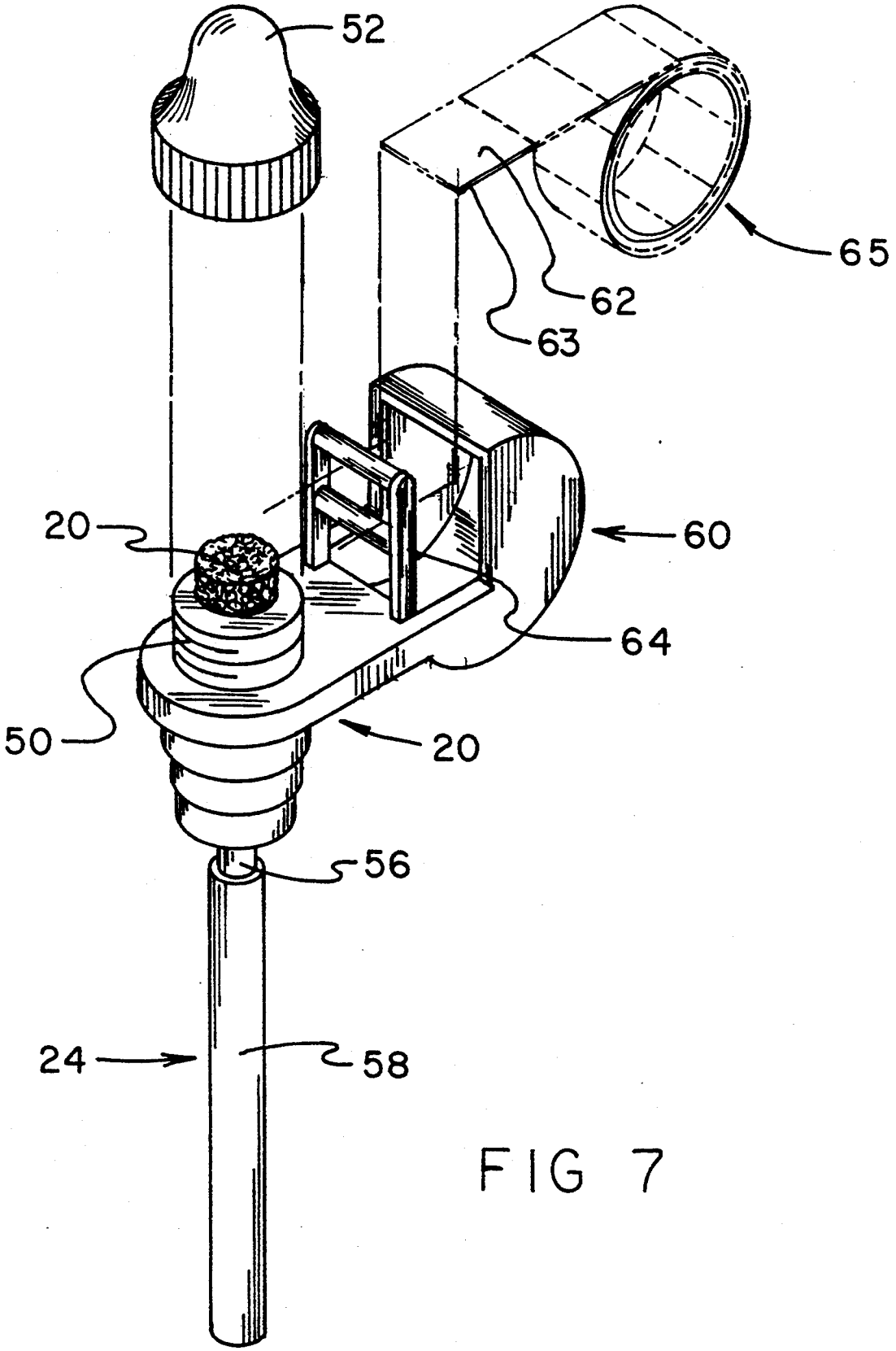
FIG. 7 is a partially exploded perspective view of a third preferred embodiment of the invention of the envelope and stamp moisturizer of the invention wherein a stamp supply retention assembly is provided for retaining a plurality of stamps to be moistened by the moisture dispensing element.

Turning to FIG. 7, a third embodiment of the invention is shown. Reference numerals are shown that correspond to like reference numerals that designate like elements shown in the other figures. In addition, a stamp supply retention assembly 60 is connected to an exterior portion of the stopper assembly 20 for retaining a plurality of stamps 62 and for permitting the stamps 62 to be removed from tile stamp supply retention assembly 60 in a manner such that the adhesive-containing surfaces 63 of the removed stamps 62 contact the moisture dispensing element 22. The plurality of stamps 62 are retained in the stamp supply retention assembly 60 in roll form 65. The stamp supply retention assembly 60 includes a guide assembly 64 for guiding the stamps 62 to the moisture dispensing element 22.

The components of the envelope and stamp moistening apparatus of the invention can be made from inexpensive and durable plastic materials.

It is apparent from the above that tile present invention accomplishes all of the objects set forth by providing a new and improved envelope and stamp moistening apparatus that is low in cost, relatively simple in design and operation, which is light weight, and which is suitable for hand-held use. With the invention, an envelope and stamp moistening apparatus is provided which can be inverted without spilling the water supply. With the invention, an apparatus is provided which does not spill water when the device is moved from side to side. With the invention, an envelope and stamp moistening apparatus is provided which includes a positive pressure water applying system that is an improvement over passive soaking methods. With the invention, an apparatus is provided which can readily be carried in person's pocket without the risk of water spillage. With the invention, an envelope and stamp moistening apparatus is provided which is readily adaptable to small or large water supplies. With the invention, an apparatus is provided which is especially adapted to moistening stamps and has an adjacent stamp dispenser for readily applying moisture to the stamps as they are dispensed from the dispenser.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved moistening apparatus, comprising:

a bottle which includes a mouth portion and a body portion, and a moisture dispensing assembly connected to said mouth portion of said bottle, said moisture dispensing assembly including a stopper assembly connected to said mouth portion of said bottle with a water tight connection, wherein said stopper assembly is hollow and includes a relatively large diameter mid-portion a tapered top portion having both its inner and outer surfaces tapering upward from said mid-portion, and a tapered bottom portion having both its inner and outer surfaces tapering downward from said mid-portion, a moisture dispensing element supported within and retained by said hollow stopper assembly, and a conduit tube assembly connected to and in fluid communication with said moisture dispensing element, said conduit tube assembly extending from said moisture dispensing element to an interior portion of said body portion of said bottle for conveying water from said body portion to said moisture dispensing element, wherein said moisture dispensing element is a sponge element, wherein said bottle is a squeezable bottle, such that by squeezing said bottle, water is forced by positive pressure from said body portion through said conduit tube assembly to said moisture dispensing element, and wherein said stopper assembly is connected to said mouth portion of said bottle by a water tight friction fit.

2. A moisture dipensing assembly apparatus for connection to a bottle having a mouth portion and a body portion which includes an interior portion for retaining water, said moisture dispensing ssembly apparatus comprising:

a stopper assembly adapted for being connected to the mouth portion of the bottle with a water tight connection, wherein said stopper assembly is hollow and includes a relatively large diameter mid-portion a tapered top portion having both its inner and outer surfaces tapering upward from said mid-portion, and a tapered bottom portion having both its inner and outer surfaces tapering downward from said mid-portion, a moisture dispensing element supported by and retained within said hollow stopper assembly, and a conduit tube assembly connected to and in fluid communication with said moisture dispensing element, said conduit tube assembly extending from said moisture dispensing element to an interior portion of said body portion of said bottle for conveying water from said body portion to said moisture dispensing element, and wherein said stopper assembly is adapted for being connected to the mouth portion of the bottle by a water tight friction fit.

* * * * *